US005917146A

United States Patent [19]

Hiskey et al.

[11] Patent Number: 5,917,146

[45] **Date of Patent: *Jun. 29, 1999**

[54] HIGH-NITROGEN ENERGETIC MATERIAL BASED PYROTECHNIC COMPOSITIONS

[75] Inventors: Michael A. Hiskey, Los Alamos; David E. Chavez, Ranchos de Taos, both of N.Mex.

[73] Assignee: The Regents of the University of California, Los Alamos, N.Mex.

[ * ] Notice: This patent issued on a continued prosecution application filed under 37 CFR 1.53(d), and is subject to the twenty year patent term provisions of 35 U.S.C. 154(a)(2).

[21] Appl. No.: 08/865,412

[22] Filed: May 29, 1997

[51] Int. Cl.[6] ..... C06B 31/02

[52] U.S. Cl. ..... 149/36; 149/46; 149/61; 149/76

[58] Field of Search ..... 149/36, 46, 76, 149/61

[56] References Cited

U.S. PATENT DOCUMENTS

| | | | |
|---|---|---|---|
| 3,244,702 | 4/1966 | Marcus et al. | 260/241 |
| 3,697,339 | 10/1972 | Sartea et al. | 149/36 |
| 3,797,238 | 3/1974 | Iwanciow et al. | 149/36 |
| 3,940,298 | 2/1976 | Beckert et al. | 149/92 |
| 4,078,954 | 3/1978 | Bernardy | 149/19.8 |
| 5,197,758 | 3/1993 | Lund et al. | 149/61 |
| 5,198,046 | 3/1993 | Bucerius et al. | 149/36 |
| 5,281,706 | 1/1994 | Coburn et al. | 544/179 |
| 5,449,423 | 9/1995 | Cioffe | 149/61 |
| 5,472,534 | 12/1995 | Wardle et al. | 149/36 |
| 5,525,166 | 6/1996 | Cook | 149/77 |

OTHER PUBLICATIONS

Marcus et al., Journal of Org. Chem., vol. 28, pp. 2372–2378, Sep. 1963.

*Primary Examiner*—Edward A. Miller
*Attorney, Agent, or Firm*—Bruce H. Cottrell

[57] ABSTRACT

A low-smoke producing pyrotechnic composition including a high-nitrogen content, low-carbon content energetic material; an oxidizing agent; and, a colorant is disclosed.

17 Claims, No Drawings

HIGH-NITROGEN ENERGETIC MATERIAL BASED PYROTECHNIC COMPOSITIONS

FIELD OF THE INVENTION

The present invention relates to pyrotechnic compositions and more particularly to low-smoke pyrotechnic compositions including a high-nitrogen content, low-carbon content energetic material. This invention was made with government support under Contract No. W-7405-ENG-36 awarded by the U.S. Department of Energy. The government has certain rights in the invention.

BACKGROUND OF THE INVENTION

Pyrotechnic compositions are often employed at amusement parks in the form of colorful fireworks. Unfortunately, the burning of large quantities of such pyrotechnics can generate large amounts of smoke that depending upon the particular weather conditions, such as wind direction, wind speed and relative humidity, can block the view of subsequent fireworks or envelop audiences in clouds of smoke.

A fireworks projectile typically consists of two principal components, an initial burst and a main burst. Black powder is one of the oldest pyrotechnic propulsion agents and is typically used as the initial burst and the main burst. The main burst also includes smaller color producing pellets referred to as "stars". Igniting the stars during detonation of the main burst provides the light and color of a fireworks display. Among typical compositions for a red star have been: (1) potassium chlorate, strontium carbonate, charcoal, red gum (or shellac), and dextrin (or rice starch); (2) potassium perchlorate, strontium carbonate, charcoal, red gum (or shellac), dextrin (or rice starch) and polyvinyl chloride; or (3) strontium nitrate, red gum (or shellac), magnalium (an alloy of aluminum and magnesium) and Parlon® chlorinated rubber $(C_6H_6Cl_4)_n$. Unfortunately, such typical compositions generate various quantities of smoke.

It is an object of this invention to provide a low smoke pyrotechnic composition, preferably an essentially smoke-free pyrotechnic composition.

Another object of the present invention is to provide a pyrotechnic composition including a high-nitrogen content, low-carbon content energetic material.

SUMMARY OF THE INVENTION

To achieve the foregoing and other objects, and in accordance with the purposes of the present invention, as embodied and broadly described herein, a low-smoke producing pyrotechnic composition is provided including a high-nitrogen content, low-carbon content energetic material selected from the group consisting of dihydrazino-s-tetrazine, derivatives of dihydrazino-s-tetrazine and salts of dihydrazino-s-tetrazine; an oxidizing agent; and, a colorant.

The present invention further provides a pyrotechnic composition including a high-nitrogen content, low-carbon content energetic material selected from the group consisting of dihydrazino-s-tetrazine, derivatives of dihydrazino-s-tetrazine and salts of dihydrazino-s-tetrazine; ammonium nitrate; and, a strontium-containing colorant, said pyrotechnic composition further characterized as producing a strobe light effect upon combustion.

DETAILED DESCRIPTION

The present invention is concerned with pyrotechnic compositions and especially with fireworks compositions. The fireworks compositions of the present invention are characterized as low-smoke compositions and can be formulated essentially smoke-free. Other compositions of the present invention are found to produce a strobe-like effect.

The pyrotechnic compositions of the present invention include a high-nitrogen content, low-carbon content energetic material as a principal component. Among suitable high-nitrogen content energetic materials are included dihydrazino-s-tetrazine and derivatives of dihydrazino-s-tetrazine including salts of dihydrazino-s-tetrazine. Suitable salts of dihydrazino-s-tetrazine may include the chloride salt, the perchlorate salt and a halogen acid of the dihydrazino-s-tetrazine. Dihydrazino-s-tetrazine, sometimes referred to as 3,6-dihydrazino-s-tetrazine is preferred as the high-nitrogen content, low carbon content energetic material. While not wishing to be bound by the present explanation, it is believed that the heat of formation of an energetic material and the burn rate of the material are important considerations in the selection of energetic material. Surprisingly, it has been found that not any high-nitrogen content, low-carbon content energetic material gave the desired results as trihydrazino-triazine did not work as an energetic material for the compositions of the present invention.

In addition to the high-nitrogen content, low-carbon content energetic materials, the pyrotechnic compositions of the present invention include an oxidizer. Suitable oxidizers can generally include ammonium perchlorate, alkali perchlorates such as potassium perchlorate and the like, ammonium nitrate and alkali nitrates such as potassium nitrate and the like. Alkali chlorates may be employed as an oxidizer but are not preferred due to sensitivity problems. Ammonium perchlorate and ammonium nitrate are preferred oxidizers as the absence of any metal ions is better for control of the fireworks color and eliminates any ash residue. Ammonium perchlorate has the added benefit of providing a source of chlorine to the pyrotechnic composition as it is generally known that a good quality pyrotechnic flame requires a source of chloride ions. Additionally ammonium nitrate is hygroscopic and compositions including ammonium nitrate must be protected from moisture.

The oxidizer is generally added with the high-nitrogen content, low-carbon content energetic materials in amounts sufficient to provide about three equivalents of free oxygen. Generally, the compositions can include from about 40 to about 60 percent by weight of the high-nitrogen content, low-carbon content energetic material together with from about 40 to about 60 percent by weight of the selected oxidizer. Colorant is also added together with the fuel and oxidizer.

Various metal salts can be employed as colorants or coloring agents to generate selected colors for the pyrotechnic compositions. Those skilled in the art recognize that each metal of the periodic table has well known spectra associated with the burning of such metals. Among the metal salts are calcium salts such as calcium chloride for the color red-orange, strontium salts such as strontium nitrate for the color red, barium salts such as barium nitrate for the color green, boron compounds for the color green, sodium salts such as sodium nitrate for the color orange-yellow, copper salts such as copper chloride for the color blue, potassium salts such as potassium chloride for the color purple or violet, and antimony salts such as antimony sulfide for the color white. Combinations of metal salts can yield other desirable colors. For example, a combination of copper sulfide and barium nitrate has given a turquoise or blue-green color, a combination of copper sulfide, barium nitrate and strontium nitrate has given a red-purple color, and a combination of barium nitrate and sodium nitrate has given a yellow color. Other metal salts such as cadmium, uranium, gold, mercury, arsenic and lead may be used to provide other colors if desired. Nitrate salts are generally preferred over salts such as chloride salts as the chloride salts tend to be hydrates and contribute undesired water. The colorant is generally added in amounts of from about 1 percent by weight to about 20 percent by weight, preferably from about 5 percent by weight to about 10 percent by weight based on total weight of fuel, oxidant and colorant.

Chlorine can be added to the compositions by addition of a metal chloride salt as the colorant, by use of ammonium perchlorate as the oxidizer or by use of the chloride salt of the dihydrazino-s-tetrazine. Use of ammonium perchlorate as the oxidizer or as part of the oxidizer is generally preferred to supply the chloride ions.

Metal flakes or particles may be added to the pyrotechnic compositions to provide a glitter effect. Suitable metals can include aluminum, magnesium, titanium and iron. The iron can generally be added in the form of steel shavings to avoid rusting problems from moisture.

One preferred pyrotechnic formulation including ammonium perchlorate as an oxidizer includes about 5 percent by weight of the selected colorant or coloring agent with the remainder being about equal amounts by weight of the ammonium perchlorate oxidizer and the dihydrazino-s-tetrazine high-nitrogen content, low-carbon content energetic material.

One preferred pyrotechnic formulation including ammonium nitrate as an oxidizer includes about 8 percent by weight of the selected colorant or coloring agent with the remainder being about 45 percent by weight of the ammonium nitrate oxidizer, about 39 percent by weight of the dihydrazino-s-tetrazine high-nitrogen content, low-carbon content energetic material, and about 8 percent by weight of ammonium perchlorate as a secondary oxidizer and chlorine supply.

The pyrotechnic compositions of the present invention can be arranged into a typical shell construction or a typical roman candle construction as are commonly used in the fireworks industry. Such common constructions generally include a multiple of stars formed of the pyrotechnic compositions of the present invention together with appropriate amounts of black powder, bursting charge, any necessary lifting charge and any necessary time delay fusing.

In the course of research on pyrotechnic compositions producing low-smoke or essentially no smoke, certain compositions have been found upon burning to produce a strobe light effect. Among the compositions found to produce a strobe or oscillating are included dihydrazino-s-tetrazine, ammonium nitrate and strontium nitrate.

The present invention is more particularly described in the following examples which are intended as illustrative only, since numerous modifications and variations will be apparent to those skilled in the art.

EXAMPLE 1

A star was formulated as follows. The energetic material, dihydrazino-s-tetrazine, was mixed together with an oxidant (ammonium perchlorate or ammonium nitrate) and from about 10 to about 15 percent by weight of a metal salt coloring agent. The powder mixture was then moistened with water for ammonium perchlorate or with ethanol for ammonium nitrate, packed into the paper form and dried.

Upon ignition, the following colors were obtained. Strontium nitrate gave red, sodium nitrate gave orange, a mixture of 12 parts barium nitrate to one part sodium nitrate gave yellow, barium nitrate gave green, copper chloride ($CuCl_2 2H_2O$ or $CuCl_2 2NH_4Cl2H_2O$) gave blue, potassium chloride or strontium nitrate with barium nitrate gave purple, calcium chloride gave pink-orange, and antimony sulfide (20 percent by weight) gave white.

Compositions including ammonium nitrate and strontium nitrate yielded a strobe effect but with some minor generation of smoke due to incomplete combustion during the strobing.

The compositions of the present invention can be used as fireworks for outdoors displays or may be used indoors, e.g., in the production of special effects for the film industry.

Although the present invention has been described with reference to specific details, it is not intended that such details should be regarded as limitations upon the scope of the invention, except as and to the extent that they are included in the accompanying claims.

What is claimed is:

1. A low-smoke producing pyrotechnic composition comprising:

a high-nitrogen content, low-carbon content energetic material selected from the group consisting of dihydrazino-s-tetrazine, derivatives of dihydrazino-s-tetrazine and salts of dihydrazino-s-tetrazine;

an oxidizing agent; and, a colorant.

2. The low-smoke producing pyrotechnic composition of claim 1 wherein said high-nitrogen content, low-carbon content energetic material is dihydrazino-s-tetrazine.

3. The low-smoke producing pyrotechnic composition of claim 1 wherein said oxidizing agent is selected from the group consisting of ammonium perchlorate and ammonium nitrate with the proviso that said pyrotechnic composition includes at least one chlorine containing material.

4. The low-smoke producing pyrotechnic composition of claim 1 wherein said colorant is a metal salt.

5. The low-smoke producing pyrotechnic composition of claim 4 wherein said metal salt includes a metal selected from the group consisting of calcium, barium, strontium, potassium, sodium, copper, and antimony.

6. The low-smoke producing pyrotechnic composition of claim 3 wherein said high-nitrogen content, low-carbon content energetic material is dihydrazino-s-tetrazine.

7. The low-smoke producing pyrotechnic composition of claim 6 wherein said oxidizing agent is selected from the group consisting of ammonium perchlorate and ammonium nitrate with the proviso that said pyrotechnic composition includes at least one chlorine containing material.

8. The low-smoke producing pyrotechnic composition of claim 6 wherein said oxidizing agent is ammonium perchlorate.

9. The low-smoke producing pyrotechnic composition of claim 6 wherein said oxidizing agent is ammonium nitrate with the proviso that said pyrotechnic composition further includes at least one chlorine containing material selected from the group of ammonium perchlorate and a metal chloride salt.

10. The low-smoke producing pyrotechnic composition of claim 1 wherein said composition includes from about 40 to about 60 percent by weight dihydrazino-s-tetrazine, from about 40 to about 60 percent by weight ammonium perchlorate, and from about 1 to about 10 percent by weight colorant.

11. The low-smoke producing pyrotechnic composition of claim 1 wherein said composition includes from about 30 to about 60 percent by weight dihydrazino-s-tetrazine, from about 40 to about 60 percent by weight ammonium nitrate, from about 1 to about 10 percent by weight ammonium perchlorate, and from about 1 to about 10 percent by weight colorant.

12. The low-smoke producing pyrotechnic composition of claim 1 wherein said colorant includes about one part by weight copper sulfide to about 8 parts by weight barium nitrate, said composition characterized as yielding a turquoise color.

13. A pyrotechnic composition comprising:

a high-nitrogen content, low-carbon content energetic material selected from the group consisting of dihydrazino-s-tetrazine, derivatives of dihydrazino-s-tetrazine and salts of dihydrazino-s-tetrazine;

ammonium nitrate; and, a strontium-containing colorant, said pyrotechnic composition further characterized as producing a strobe light effect upon combustion.

14. The pyrotechnic composition of claim 13 wherein said colorant includes a copper-containing colorant metal, a barium-containing colorant and a strontium-containing colorant.

15. The pyrotechnic composition of claim 13 wherein said high-nitrogen content, low-carbon content energetic material is dihydrazino-s-tetrazine.

16. The pyrotechnic composition of claim 14 wherein said high-nitrogen content, low-carbon content energetic material is dihydrazino-s-tetrazine.

17. The pyrotechnic composition of claim 14 wherein said colorant includes about one part by weight copper sulfide to about one part by weight barium nitrate to about three parts by weight strontium nitrate, said composition characterized as yielding a red-purple color.

* * * * *